US012559828B2

(12) United States Patent
Hamamoto et al.

(10) Patent No.: US 12,559,828 B2
(45) Date of Patent: Feb. 24, 2026

(54) GALVANIZED STEEL SHEET FOR HOT STAMPING, HOT STAMPED PART, AND METHOD FOR PRODUCING HOT-STAMPED PART

(71) Applicant: Kobe Steel, Ltd., Kobe (JP)

(72) Inventors: Sae Hamamoto, Kakogawa (JP); Keisuke Nakata, Kakogawa (JP); Tatsuya Asai, Kakogawa (JP); Kenji Saito, Kakogawa (JP)

(73) Assignee: Kobe Steel, Ltd., Kobe (JP)

( * ) Notice: Subject to any disclaimer, the term of this patent is extended or adjusted under 35 U.S.C. 154(b) by 29 days.

(21) Appl. No.: 17/759,325

(22) PCT Filed: Jan. 7, 2021

(86) PCT No.: PCT/JP2021/000299
§ 371 (c)(1),
(2) Date: Jul. 22, 2022

(87) PCT Pub. No.: WO2021/153177
PCT Pub. Date: Aug. 5, 2021

(65) Prior Publication Data

US 2023/0125053 A1 Apr. 20, 2023

(30) Foreign Application Priority Data

Jan. 31, 2020 (JP) ..... 2020-014489

(51) Int. Cl.

| | |
|---|---|
| ***C23C 2/06*** | (2006.01) |
| ***B21D 22/02*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |
| ***C23C 2/40*** | (2006.01) |

(52) U.S. Cl.
CPC ..... *C23C 2/06* (2013.01); *B21D 22/022* (2013.01); *C21D 8/0205* (2013.01); *C21D 9/46* (2013.01); *C22C 38/001* (2013.01); *C22C 38/002* (2013.01); *C22C 38/004* (2013.01); *C22C 38/02* (2013.01); *C22C 38/04* (2013.01); *C22C 38/06* (2013.01); *C22C 38/14* (2013.01); *C23C 2/40* (2013.01)

(58) Field of Classification Search
None
See application file for complete search history.

(56) References Cited

U.S. PATENT DOCUMENTS

| | | | | |
|---|---|---|---|---|
| 2011/0236719 | A1 | 9/2011 | Hensen et al. | |
| 2012/0211123 | A1 | 8/2012 | Honda et al. | |
| 2014/0056753 | A1* | 2/2014 | Naitou | B21D 37/16 420/104 |
| 2015/0125716 | A1* | 5/2015 | Kojima | C22C 38/001 148/533 |
| 2015/0225830 | A1 | 8/2015 | Nonaka et al. | |
| 2016/0067947 | A1 | 3/2016 | Minowa et al. | |
| 2016/0122845 | A1 | 5/2016 | Akiba et al. | |
| 2016/0222483 | A1* | 8/2016 | Murakami | C22C 38/06 |
| 2016/0312330 | A1 | 10/2016 | Hayashi | |
| 2017/0029914 | A1 | 2/2017 | Hayashi | |
| 2017/0183751 | A1* | 6/2017 | Tsunezawa | C22C 38/26 |
| 2018/0023154 | A1* | 1/2018 | Hasegawa | C23C 2/28 148/530 |
| 2018/0281348 | A1* | 10/2018 | Otomo | B21D 22/20 |
| 2019/0169729 | A1* | 6/2019 | Yokoyama | C22C 38/06 |

FOREIGN PATENT DOCUMENTS

| | | | | |
|---|---|---|---|---|
| EP | 2 843 077 | A1 | 3/2015 | |
| EP | 2 990 501 | A1 | 3/2016 | |
| JP | 2001-207221 | A | 7/2001 | |
| JP | 2001-207235 | A | 7/2001 | |
| JP | 2006-37141 | A | 2/2006 | |
| JP | 2007169679 | A * | 7/2007 | |
| JP | 2016-89274 | A | 5/2016 | |
| RU | 2 605 404 | C2 | 12/2016 | |
| RU | 2 621 501 | C1 | 6/2017 | |
| RU | 2 625 374 | C1 | 7/2017 | |
| RU | 2 650 233 | C1 | 4/2018 | |
| RU | 2 693 226 | C1 | 7/2019 | |
| WO | WO-2018011978 | A1 * | 1/2018 | B32B 15/00 |

OTHER PUBLICATIONS

Extended European Search Report issued Apr. 4, 2023 in the European Patent Application No. 21748284.3, 7 pages.
International Search Report issued Mar. 30, 2021, in PCT/JP2021/000299, filed on Jan. 7, 2021, 2 pages.
International Preliminary Report on Patentability and Written Opinion issued Aug. 11, 2022, in PCT/JP2021/000299, 5 pages.
Official Communication was issued on Jan. 5, 2026, in corresponding European Patent Application No. 21748284.3. citing document 2 therein.

(Continued)

*Primary Examiner* — Seth Dumbris

(74) *Attorney, Agent, or Firm* — Oblon, McClelland, Maier & Neustadt, L.L.P.

(57) ABSTRACT

A zinc-plated steel sheet for hot stamping according to an aspect of the present invention includes a base steel sheet satisfying a predetermined composition of chemical components, wherein an amount of solid-soluted B is 10 ppm or more and the base steel sheet has a hot-dip galvannealed layer or a hot dip galvanized layer on at least one face thereof.

7 Claims, No Drawings

(56) References Cited

OTHER PUBLICATIONS

L Holappa, "On Physico-Chemical and Technical Limits in Clean Steel Production " Steel Research International, Verlag Stahleisen Gmbh., Dusseldorf, DE, vol. 81, No. JO, Oct. 1, 2010, pp. 869-874, XP009522146, Retrieved from the Internet: URL:https://api.wiley.com/onlinelibrary/tdm/v I/articles/10.1002%2Fsrin.201000203.

* cited by examiner

GALVANIZED STEEL SHEET FOR HOT STAMPING, HOT STAMPED PART, AND METHOD FOR PRODUCING HOT-STAMPED PART

CROSS-REFERENCE TO RELATED APPLICATIONS

This application is a National Stage entry under 35 U.S.C. § 371 of PCT/JP2021/000299, filed on Jan. 7, 2021, and claims priority to Japanese Patent Application No. 2020-014489, filed on Jan. 31, 2020, the entire contents of which are incorporated herein by reference.

TECHNICAL FIELD

The present invention relates to a zinc-plated steel sheet for hot stamping, a hot stamped part obtained by using the zinc-plated steel sheet for hot stamping, and a method for producing a hot stamped part. The present invention particularly relates to a zinc-plated steel sheet for hot stamping having a tensile strength TS of less than 1.5 GPa after heat treatment, in which occurrence of liquid metal embrittlement (LME) can be inhibited when hot stamped, a hot stamped part obtained by using such a zinc-plated steel sheet for hot stamping, and a method for producing a hot stamped part.

BACKGROUND ART

Hot stamping including press forming a steel sheet at a high temperature has been proposed as a technique capable of achieving both high strength and complicated shape in the production of automotive parts. Hereinafter, the steel sheet to be subjected to hot stamping may be referred to as "blank".

Hot stamping is also called hot forming, hot pressing, or the like, and is a method of heating the blank to a temperature in the austenite temperature range, that is, a high temperature equal to or more than the $Ac_3$ transformation point, and press forming the blank. Hereinafter, the heating step of the blank may be referred to as "heating step of hot stamping". Hereinafter, the heating step of hot stamping and the subsequent part forming step of press forming the blank may be collectively referred to as "hot stamping step". With such a hot stamping technique, it is possible to obtain a hot stamped part such as an automobile part having a complicated shape and at the same time having high strength.

Most of the hot stamped parts produced by the hot stamping step have a tensile strength TS of 1.5 GPa or more. However, in recent years, various hot stamped parts having a tensile strength TS of less than 1.5 GPa, such as a steel member having a tensile strength TS of 800 to 1300 MPa, have been proposed.

As the blank, a steel sheet obtained by pickling after hot rolling, that is, a hot rolled pickled steel sheet, or a cold rolled steel sheet obtained by further cold rolling the steel sheet is used, and from the viewpoint of corrosion resistance and scale suppression, a plated steel sheet obtained by plating at least one face of the hot rolled pickled steel sheet or cold rolled steel sheet is also used. The plated steel sheet is, mainly, roughly classified into a zinc-based plated steel sheet and an Al-based plated steel sheet. The present invention is directed to a zinc-plated steel sheet.

When the zinc-plated steel sheet as described above is applied to the hot stamping step, the occurrence of LME becomes a problem. Zn constituting the galvanization has a melting point of 419° C. and a boiling point of 907° C. and becomes a liquid phase or a gas phase in a heating temperature range of hot stamping. The LME occurs because of zinc having a low melting point as described above, the zinc melting in the heating step of hot stamping of the zinc-plated steel sheet as a blank and entering grain boundaries of the base steel sheet in the part forming step. A crack generated by the LME has a problem of causing great losses of the impact resistance and durability of the formed part depending on the depth of the crack. Hereinafter, the crack generated by the LME is referred to as "LME crack".

As a technique for avoiding a problem of LME crack generation, for example, a technique such as Patent Literature 1 was proposed. In this technique, alloying of zinc and iron is advanced in the heating step of hot stamping to reduce the LME crack depth. That is, to increase the Fe % in a plated layer, a heating up to 300° C. or more is performed as a pretreatment of part forming, and the heat treatment time at the heating is made long, for example, 300 to 1000 seconds. However, the method disclosed in Patent Literature 1 is not practical because it requires increased number of hot stamping steps, a plurality of heating furnaces having different set temperatures, and an extension of the heat treatment time.

In addition, for example, Patent Literature 2 proposes a method of performing a galvanizing treatment after Ni plating, and Patent Literature 3 proposes a technique for avoiding the LME crack generation by controlling the components in a zinc-plated layer.

Further, it is also known that the contribution of chemical components of the base steel sheet is also large and reducing the amount of Si is particularly important for avoiding the LME crack generation. On the other hand, Si is also known to be an element useful in a high strength steel sheet, for example, contributing to improvement of joint strength of a spot-welded portion (Patent Literature 4).

In the hot stamping techniques proposed so far, tissue control is performed in the process of hot stamping to control the tensile strength TS. For this reason, the tensile strength TS of a hot stamped part greatly depends on the process of hot stamping in practice. To avoid the LME crack generation, it is common to adopt a method of modifying a plated layer by controlling the components in a zinc-plated layer, or a method of reducing an additive element useful in a high strength steel sheet, or the like.

For example, in Patent Literature 1, alloying of zinc and iron is progressed in the heating step of hot stamping to reduce the LME crack depth, but in a normal hot dip galvannealed steel sheet in which the progress of alloying is not actively performed, the LME crack generation cannot be avoided. Such a problem also occurs in a hot dip galvanized steel sheet.

CITATION LIST

Patent Literature

Patent Literature 1: JP 2012-512747 A
Patent Literature 2: JP 2016-89274 A
Patent Literature 3: JP 2006-037141 A
Patent Literature 4: JP 2007-169679 A

SUMMARY OF INVENTION

The present invention is achieved in view of the above circumstances, and an object of the present invention is to provide a zinc-plated steel sheet for hot stamping in which an LME crack generation can be avoided without reducing the amount of Si and without greatly depending on modification with chemical components in a plated layer or the process of hot stamping, a hot stamped part obtained by using such a zinc-plated steel sheet for hot stamping, and a method for producing a hot stamped part.

The present inventors found that the above object can be achieved by the following configuration and achieved the present invention by further conducting studies based on the findings.

That is, a zinc-plated steel sheet for hot stamping according to an aspect of the present invention includes a base steel sheet containing, in % by mass:

C: 0.005 to 0.14%,
Si: 1.0 to 1.7%,
Mn: 1.5 to 3.0%,
Ti: 0.010 to 0.100%,
B: 0.0010 to 0.0100%,
Al: 0.01 to 0.10%,
P: 0.10% or less (not including 0%),
S: 0.010% or less (not including 0%),
N: 0.010% or less (not including 0%), and
a balance being iron and unavoidable impurities,
wherein an amount of solid-soluted B is 10 ppm or more, and
the base steel sheet has a hot-dip galvannealed layer or a hot dip galvanized layer on at least one face thereof.

DESCRIPTION OF EMBODIMENTS

The present inventors have studied from various angles to achieve the above object. That is, the present inventors have conducted intensive studies from the viewpoint of realizing a zinc-plated steel sheet for hot stamping in which an LME crack generation can be avoided without reducing the amount of Si and without greatly depending on modification with chemical components in a plated layer or the process of hot stamping.

As a result, the present inventors have found that the above object is successfully achieved by appropriately adjusting the composition of chemical components of the base steel sheet as described later and securing a predetermined amount of B present in a solid-soluted state (hereinafter, also referred to as "solid-soluted B") in the base steel sheet, and have completed the present invention. The present invention can provide a zinc-plated steel sheet for hot stamping in which an LME crack generation can be avoided without reducing the amount of Si and without greatly depending on modification with chemical components in a plated layer or the process of hot stamping.

Hereinafter, embodiments of the present invention will be described more specifically, but the present invention is not limited thereto.

The reasons of the setting of the composition of chemical components of a base steel sheet in the zinc-plated steel sheet for hot stamping of the present embodiment are as follows. Hereinafter, % in the composition of chemical components means % by mass.

In the zinc-plated steel sheet for hot stamping of the present embodiment, the base steel sheet satisfies C: 0.005 to 0.14%, Si: 1.0 to 1.7%, Mn: 1.5 to 3.0%, Ti: 0.010 to 0.100%, B: 0.0010 to 0.0100%, Al: 0.01 to 0.10%, P: 0.10% or less (not including 0%), S: 0.010% or less (not including 0%), and N: 0.010% or less (not including 0%).

[C: 0.005 to 0.14%]

C (carbon) is an important element for avoiding the LME crack generation. To avoid the LME crack generation, it is desirable that the amount of C is as small as possible. However, excessive reduction of the amount of C leads to an increase in production cost, and therefore the amount of C is set to 0.005% or more. The amount of C is preferably 0.007% or more, more preferably 0.010% or more. However, an excessive amount of C causes the strength of the steel sheet to increase and the cross tensile strength (breaking load of a cross joint by the cross shape tensile test method) of a spot-welded portion to decrease when the steel sheet is spot welded, which tends to generate an LME crack. The upper limit of the amount of C therefore needs to be 0.14% or less. The amount of C is preferably 0.13% or less, and more preferably 0.12% or less.

[Si: 1.0 to 1.7%]

Si (silicon) is an important element for increasing the cross tensile strength of a spot-welded portion when the steel sheet is spot welded. Si is also an element that contributes to reducing the process dependency of hot stamping in a hot stamped part and achieving hardness stability. To exhibit such an effect, the amount of Si needs to be 1.0% or more. The amount of Si is preferably 1.05% or more, more preferably 1.1% or more. However, an excessive amount of Si causes deterioration of pickling property due to an increase in oxidation scale during production of a steel sheet, deterioration of plating property, an increase in $Ac_3$ transformation point, a decrease in cross tensile strength of a spot-welded portion, and the like. The amount of Si is therefore set to 1.7% or less. The amount of Si is preferably 1.6% or less, and more preferably 1.5% or less.

[Mn: 1.5 to 3.0%]

Mn (manganese) is an element useful for improving hardenability of the steel sheet and reducing variations in hardness after forming. To exhibit such an effect, the amount of Mn needs to be 1.5% or more. The amount of Mn is preferably 1.7% or more, more preferably 2.0% or more. However, an excessive amount of Mn exceeding 3.0% saturates the effect and increases the cost. The amount of Mn therefore needs to be 3.0% or less, preferably 2.8% or less, and more preferably 2.6% or less.

[Ti: 0.010 to 0.100%]

In the present embodiment, Ti (titanium) is an important element. Containing Ti causes the production of TiN to be promoted and the amount of solid-soluted B that inhibits the LME crack generation to increase. To exhibit such an effect, the amount of Ti needs to be 0.010% or more. The amount of Ti is preferably 0.012% or more, more preferably 0.015% or more. However, an excessive amount of Ti tends to generate TiC, refines the steel structure, and deteriorates the hardenability. The amount of Ti therefore needs to be 0.100% or less, preferably 0.095% or less, and more preferably 0.090% or less.

[B: 0.0010 to 0.0100%]

In the present embodiment, B (boron) is an important element. B is known as an element that strengthens a grain boundary and has an effect on hardenability. In the present embodiment, it is found that containing B in the base steel sheet can inhibit the LME crack generation in the heating step of hot stamping. To obtain such an effect, the amount of B needs to be 0.0010% or more. The amount of B is preferably 0.0012% or more, more preferably 0.0015% or more. However, an excessive amount of B causes surface cracking or the like at the time of casting due to generation of a B compound or the like. The amount of B therefore needs to be 0.0100% or less. The amount of B is preferably 0.0090% or less, and more preferably 0.0085% or less.

[Al: 0.01 to 0.10%]

Al (aluminum) is an element that acts as a deoxidizing agent. To exhibit such an effect, the amount of Al needs to be 0.01% or more. The amount of Al is preferably 0.015% or more, more preferably 0.020% or more. However, containing an excess amount of Al increases the production cost, and the amount of Al is therefore set to 0.10% or less. The amount of Al is preferably 0.080% or less, and more preferably 0.070% or less.

[P: 0.10% or Less (not Including 0%)]

P (phosphorus) is an element that is inevitably contained, but it is desirable to limit the content of P as much as possible since it is an element that deteriorates weldability of the steel sheet. To keep the weldability of the steel sheet from deteriorating, the amount of P needs to be 0.10% or less. The amount of P is preferably 0.050% or less, more preferably 0,020% or less. Note that P is an impurity inevitably mixed in steel, and it is impossible to set the amount of P to 0% in industrial production, and P is usually contained in an amount of 0.0005% or more.

[S: 0.010% or Less (not Including 0%)]

S (sulfur) is an element inevitably contained and deteriorates weldability of the steel sheet. The amount of S is therefore set to 0.010% or less. The amount of S is preferably 0.0080% or less, and more preferably 0.0050% or less. Since the amount of S is preferably as small as possible, the lower limit is not limited to particular values, but it is impossible to set the amount of S to 0% in industrial production, and S is usually contained in an amount of 0.0001% or more.

[N: 0.010% or Less (not Including 0%)]

N (nitrogen) is an element inevitably contained, and containing an excessive amount of N tends to generate BN and reduces the amount of solid-soluted B. The amount of N is therefore set to 0.010% or less. The amount of N is preferably 0.008% or less, more preferably 0.005% or less. Since the amount of N is preferably as small as possible, the lower limit is not limited to particular values, but it is impossible to set the amount to 0% in industrial production, and N is usually contained in an amount of 0.0001% or more.

[Solid-Soluted B: 10 ppm (Ppm by Mass) or More]

As described above, to inhibit the LME crack generation in the heating step of hot stamping, it is important to secure a predetermined amount of B present in a solid-soluted state. From such a viewpoint, the amount of solid-soluted B needs to be 10 ppm or more. The amount of solid-soluted B is preferably 20 ppm or more, more preferably 50 ppm or more. The upper limit of the amount of solid-soluted B is not limited at all, but it is about 100 ppm or less when all of the contained B is turned into a solid solution.

The method for securing the amount of solid-soluted B of 10 ppm or more is not limited at all, but it is effective to react N with Ti as much as possible to obtain TiN to inhibit generation of BN that is generated by the reaction between B and N. For example, the contained B can be efficiently secured as solid-soluted B by controlling the amount of Ti and the amount of N so that they satisfy the relationship of $[Ti] \geq (47.8/14)[N]$, where the amount (% by mass) of Ti in the base steel sheet is [Ti] and the amount (% by mass) of N in the base steel sheet is [N].

The basic components of the base steel sheet used for the zinc-plated steel sheet for hot stamping of the present embodiment are as described above, and the balance is iron and unavoidable impurities other than P, S, and N. As the unavoidable impurities, in addition to O (oxygen) which is preferably reduced as described below, mixing of a trump element (Pb, Bi, Sb, Sn, V, etc.) brought depending on the situation of a raw material, a material, a production facility, or the like is allowed as long as the effect of the present invention is not impaired.

[O: 0.010% or Less (not Including 0%)]

O is an element that is inevitably contained, and containing an excessive amount of O may cause an oxide to be formed and solid-soluted B to decrease. The amount of O is therefore preferably 0.010% or less. The amount of O is more preferably 0.005% or less, and still more preferably 0.003% or less. Since the amount of O is preferably as small as possible, the lower limit is not limited to particular values, but it is impossible to set the amount of O to 0% in industrial production, and O is usually contained in an amount of 0.0001% or more.

The base steel sheet used for the steel sheet for hot stamping of the present embodiment can further contain one or more selected from the group consisting of Cr (chromium) and Mo (molybdenum) as other elements, and the properties of the steel sheet are further improved by containing these elements.

[One or More Selected from the Group Consisting of Cr: 0.5% or Less (not Including 0%) and Mo: 0.5% or Less (not Including 0%)]

Cr and Mo are elements that improve hardenability similarly to Mn and improve the steel sheet strength after the hot stamping step. Such an effect increases as the contents of Cr and Mo increase, but it is preferable that the contents of Cr and Mo are each 0.5% or less since containing an excessive amount of Cr and Mo increases the cost. More preferably, Cr and Mo are each 0.4% or less. Any one or both of Cr and Mo may be contained.

The zinc-plated steel sheet for hot stamping according to the present embodiment includes a hot dip galvanized steel sheet (GI steel sheet) or a hot dip galvannealed steel sheet (GA steel sheet) having a hot dip galvanized layer (GI) or an alloyed hot dip galvanized layer (GA) on at least one face of a hot rolled steel sheet or a cold rolled steel sheet as a base steel sheet.

In the zinc-plated steel sheet for hot stamping of the present embodiment in which the base steel sheet has the composition of chemical components as described above, the maximum tensile strength after hot pressing the base steel sheet at the $Ac_3$ transformation point of the base steel sheet can be 800 MPa or more and 1300 MPa or less. That is, by adopting the zinc-plated steel sheet for hot stamping having the above configuration, a hot stamped part having a maximum tensile strength of 800 MPa or more and 1300 MPa or less after the hot stamping step can be produced without greatly depending on the process of hot stamping.

The zinc-plated steel sheet for hot stamping according to the present embodiment is useful as a steel sheet having a tensile strength of 1000 MPa or more after heat treatment and a steel sheet for producing a tailored blank part. In a normal hot stamping step, the temperature during the heating step of hot stamping is set to the austenite single phase region temperature (that is, a temperature higher than the $Ac_3$ transformation point). Then, the steel plate heated to this temperature range is press formed while being cooled with a die to obtain a hot pressed part.

In the steel sheet having a tensile strength of 1000 MPa or more after the hot stamping step, the $Ac_3$ transformation point of the steel sheet is set to a relatively low temperature. Thus, by performing a tailored blank by welding or the like on a steel sheet having a tensile strength of 1000 MPa or more after the hot stamping step and the zinc-plated steel sheet for hot stamping of the present embodiment including a base steel sheet having an $Ac_3$ transformation point different from that of the steel sheet, then heating the steel sheets to a temperature range higher than the $Ac_3$ transformation point of any of the steel sheets, and hot pressing the steel sheets, a tailored blank material including a region having a tensile strength of 1000 MPa or more and a region having a tensile strength of 800 MPa or more and 1300 MPa or less is obtained. In such a tailored blank material, which region is the high strength side or the low strength side is determined by the relationship between the $Ac_3$ transformation point of each steel sheet and the temperature in the heating step of hot stamping.

In the present specification, the $Ac_3$ transformation point is a value calculated based on the following formula (1). The following formula (1) is a simplified formula based on the formula shown in "The Physical Metallurgy of Steels, William C. Leslie" (Maruzen Co., Ltd., issued on May 31, 1985, p. 273), in consideration of the composition of chemical components of the base steel sheet used in the zinc-plated steel sheet for hot stamping of the present embodiment.

$$Ac_3 \text{ transformation point}(^\circ \text{C.}) = 910 - 203\times[C]^{1/2} + 44.7\times[Si] - 30\times[Mn] + 700\times[P] + 400\times[Al] + 400\times[Ti] \quad (1)$$

In the above formula (1), [C], [Si], [Mn], [P], [Al], and [Ti] are values representing the contents of C, Si, Mn, P, Al, and Ti in % by mass, respectively.

As is apparent from the above method for producing a tailored blank material, the method for producing a hot stamped part according to the present embodiment includes heating the zinc-plated steel sheet for hot stamping as described above to a temperature equal to or more than an $Ac_3$ transformation point of the base steel sheet, and hot pressing the zinc-plated steel sheet. By using the zinc-plated steel sheet for hot stamping of the present embodiment, a hot stamped part exhibiting desired properties can be obtained.

The base steel sheet used in the present embodiment may be produced according to a typical procedure. For example, a steel material satisfying the composition of chemical components as described above is melted according to a common procedure, and a steel piece such as a slab is obtained by continuous casting, then the steel piece is heated to 1300° C. or less, then subjected to hot rolling, winding, then pickling and cold rolling, to obtain a cold rolled steel sheet. Thereafter, the cold rolled steel sheet is subjected to an annealing treatment as necessary to obtain a base steel sheet. A hot dip galvanizing treatment or a hot dip galvannealing treatment is performed on at least one face of the base steel sheet thus obtained.

The present specification discloses various forms of techniques as described above, and the main techniques are summarized below.

The zinc-plated steel sheet for hot stamping according to the present embodiment includes a base steel sheet containing, in % by mass:

C: 0.005 to 0.14%,
Si: 1.0 to 1.7%,
Mn: 1.5 to 3.0%,
Ti: 0.010 to 0.100%,
B: 0.0010 to 0.0100%,
Al: 0.01 to 0.10%,
P: 0.10% or less (not including 0%),
S: 0.010% or less (not including 0%),
N: 0.010% or less (not including 0%), and
a balance being iron and unavoidable impurities,
wherein an amount of solid-soluted B is 10 ppm or more, and
the base steel sheet has a hot-dip galvannealed layer or a hot dip galvanized layer on at least one face thereof.

Adopting such a configuration can realize a zinc-plated steel sheet for hot stamping in which an LME crack generation can be avoided without reducing the amount of Si and without greatly depending on modification with chemical components in a plated layer or the process of hot stamping.

In the zinc-plated steel sheet for hot stamping of the present embodiment, the base steel sheet can further contain one or more selected from the group consisting of Cr: 0.5% or less (not including 0%) and Mo: 0.5% or less (not including 0%). Containing these components can further increase the strength of the hot stamped part after the hot stamping step.

As a preferred embodiment, a zinc-plated steel sheet for hot stamping includes a base steel sheet having the composition of chemical components described above, the zinc-plated steel sheet having a maximum tensile strength of 800 MPa or more and 1300 MPa or less after hot pressed at a temperature equal to or more than an $Ac_3$ transformation point of the base steel sheet. That is, by using the zinc-plated steel sheet for hot stamping of the present embodiment, a hot stamped part having a maximum tensile strength of 800 MPa or more and 1300 MPa or less after the hot stamping step can be produced without greatly depending on the process of hot stamping.

The zinc-plated steel sheet for hot stamping according to the present embodiment is useful as a steel sheet having a tensile strength of 1000 MPa or more after the hot stamping step and a steel sheet for producing a tailored blank part.

The method for producing a hot stamped part according to the present embodiment includes heating the zinc-plated steel sheet for hot stamping as described above to a temperature equal to or more than an $Ac_3$ transformation point of the base steel sheet, and hot pressing the zinc-plated steel sheet. That is, by including heating the zinc-plated steel sheet for hot stamping of the present embodiment to a temperature equal to or more than the $Ac_3$ transformation point of the base steel sheet and hot pressing the zinc-plated steel sheet, it is possible to produce a hot stamped part exhibiting desired properties without being limited to a tailored blank material.

Hereinafter, the operation and effect of the present invention will be more specifically described based on Examples, but needless to say, the present invention is not limited to the following Examples, and any design change based on the gist described above and below is included in the technical scope of the present invention.

EXAMPLES

Various steel materials having the compositions of chemical compositions (steel types A to M) shown in the following Table 1 were melted in a factory, and subjected to casting, hot rolling, cold rolling, and plating steps to obtain GA steel sheets. These components indicate representative component values. The $Ac_3$ transformation points shown in Table 1 are values calculated based on the above formula (1). In Table 1, the column with [–] means that the component is not added, or the amount is below the measurement limit. P, S, V, and N are unavoidable impurities as described above, and the values shown in the columns of P, S, V, and N mean amounts inevitably included. When $[Ti] \geq [47.8/14]\times[N]$ is satisfied, it can be considered that all the added B is present in a solid-soluted state, but in Table 1, the amount of solid-soluted B obtained based on the amount of Ti and the amount of N is shown as an estimated value. The balance includes iron and unavoidable impurities other than the unavoidable impurities described above.

TABLE 1

| Steel type | Composition of chemical component (% by mass) C | Si | Mn | P | S | Al | Cr | Mo | V | Ti | B | N | Amount of solid-soluted B (ppm: estimated value) | $A_{c3}$ transformation point (° C.) |
|---|---|---|---|---|---|---|---|---|---|---|---|---|---|---|
| A | 0.09 | 1.49 | 2.1 | 0.009 | 0.000 | 0.033 | 0.19 | — | 0.003 | 0.023 | 0.0032 | 0.0034 | 32 | 881 |
| B | 0.12 | 1.01 | 2.4 | 0.010 | 0.001 | 0.021 | 0.25 | — | 0.005 | 0.024 | 0.0031 | 0.0033 | 31 | 838 |
| C | 0.08 | 1.13 | 2.3 | 0.010 | 0.001 | 0.044 | — | — | 0.003 | 0.029 | 0.0019 | 0.0049 | 19 | 870 |
| D | 0.21 | 1.85 | 2.0 | 0.012 | 0.001 | 0.043 | 0.19 | — | 0.004 | 0.020 | 0.0036 | 0.0026 | 36 | 873 |
| E | 0.04 | <0.02 | 0.2 | 0.010 | 0.003 | 0.040 | — | — | 0.000 | — | — | 0.0027 | 0 | 886 |
| F | 0.07 | 0.02 | 2.0 | 0.013 | 0.004 | 0.044 | 0.27 | 0.06 | 0.002 | — | — | 0.0040 | 0 | 824 |
| G | 0.09 | 0.01 | 2.8 | 0.016 | 0.002 | 0.048 | 0.28 | 0.09 | 0.005 | 0.077 | — | 0.0046 | 0 | 827 |
| H | 0.10 | 0.01 | 2.5 | 0.009 | 0.003 | 0.058 | 0.21 | 0.06 | 0.003 | — | — | 0.0044 | 0 | 801 |
| I | 0.12 | 0.02 | 2.7 | 0.010 | 0.002 | 0.048 | 0.25 | 0.07 | 0.005 | 0.072 | — | 0.0044 | 0 | 815 |
| J | 0.09 | 1.81 | 2.2 | 0.010 | 0.001 | 0.053 | 0.20 | — | 0.005 | 0.063 | 0.0002 | 0.0040 | 2 | 917 |
| K | 0.09 | 1.21 | 2.2 | 0.010 | 0.001 | 0.043 | 0.19 | — | 0.002 | — | 0.0001 | 0.0041 | 0 | 861 |
| L | 0.22 | 1.31 | 2.1 | 0.007 | 0.001 | 0.019 | — | — | 0.003 | 0.020 | 0.0001 | 0.0055 | 1 | 831 |
| M | 0.20 | 1.85 | 2.1 | 0.008 | 0.000 | 0.046 | — | — | 0.002 | — | 0.0001 | 0.0030 | 0 | 863 |

The heating step of hot stamping was simulated, and the austenitization treatment was performed by heating to 900° C., then the temperature was cooled to 800° C., and a tensile test was performed at the temperature. Two types of tensile test pieces, i.e., a test piece of a GA steel sheet and a test piece obtained by removing a GA layer by pickling (plating removed material) were prepared, and the tensile test results were compared. The results (Test Nos. 1 to 6) when using the steel types A to C and K to M shown in Table 1 are shown in the following Table 2 together with the applied steel type and the Si amount.

The sheet thickness shown in the following Table 2 is the thickness of each GA steel sheet. ΔTS/TS shown in the following Table 2 indicates {(tensile strength TS of plating removed material−tensile strength TS of GA steel sheet as is)/(tensile strength TS of plating removed material)}×100. That is, the smaller the absolute value of the value of ΔTS/TS (for example, 5 or less), the smaller the difference between the presence and absence of plating in the tensile test at 800° C., indicating that the decrease in tensile strength due to the LME crack generation is small. The tensile strengths TS at 800° C. of the GA steel sheet as is shown in Test Nos. 1 to 3 in Table 2 have values of 191 to 213 MPa, but when the condition in the hot stamping step is assumed, the maximum tensile strength TS at normal temperature is about 800 to 1300 MPa.

TABLE 2

| Test No. | Steel type | Amount of Si (% by mass) | Thickness [mm] | TS of Plating removed material [MPa] | TS of GA steel sheet as it is [MPa] | ΔTS/TS | Remarks |
|---|---|---|---|---|---|---|---|
| 1 | A | 1.49 | 1.8 | 185 | 191 | −3 | Example |
| 2 | B | 1.01 | 1.4 | 190 | 194 | −2 | Example |
| 3 | C | 1.13 | 1.2 | 216 | 213 | 1 | Example |
| 4 | K | 1.21 | 1.4 | 187 | 146 | 22 | Comparative Example |
| 5 | L | 1.31 | 1.2 | 184 | 117 | 36 | Comparative Example |
| 6 | M | 1.85 | 1.4 | 203 | 123 | 39 | Comparative Example |

The following consideration can be made from these results. Test Nos. 1 to 3 are Examples satisfying all the requirements specified in the present invention, having the values (absolute value) of ΔTS/TS of 5 or less, from which it can be seen that the LME crack generation is reduced.

On the other hand, Test Nos. 4 to 6 are Comparative Examples that do not satisfy all the requirements specified in the present invention, in which desired properties are not obtained.

In Test No. 4, the amount of solid-soluted B was not secured (steel type K in Table 1), and the LME crack generation is not reduced. In Test Nos. 5 and 6, the LME crack generation is not reduced because of the influence of any or all of the amount of solid-soluted B, the amount of Si, and the amount of C (steel type L, M in Table 1).

In the test using the steel types D to J in Table 1, the value (absolute value) of ΔTS/TS was 5 or less, and the LME crack generation was reduced, but this is an example in which something inconvenient is expected to happen for the following reasons.

In the example using the steel type D, the LME crack generation was reduced, but this is because Ti and B are both contained and the amount of solid-soluted B is large. However, even though the amount of Si is excessive, the amount of C is also large, and thus the $Ac_3$ transformation point is lowered, and the amount of C is excessive over the upper limit defined in the present invention, therefore there is a concern that the cross tensile strength decreases (for example, see "Influence of Component Element on Spot Welding Characteristics of High-Strength Thin Steel Sheet", The Resistance Welding Research Committee Document RW-78-75, p. 15, FIG. 11, issued on Dec. 4, 1975). In addition, it is assumed that the tensile strength at room temperature is about 1500 MPa, which is outside the preferable range.

In the examples using the steel types E to I, the LME crack generation was reduced because the amount of Si was reduced. However, there is a concern of deterioration in cross tensile strength and hardness stability with the reduced amount of Si.

In the example using the steel type J, the LME crack generation was reduced because the amount of C was relatively small. However, since the amount of Si is excessive over the upper limit defined in the present invention, the $Ac_3$ transformation point is higher than 907° C., and it is estimated that heating to such an extent that the galvanized layer evaporates is required, and it is expected that effective hot stamping cannot be performed.

This application is based on Japanese Patent Application No. 2020-014489 filed on Jan. 31, 2020, the contents of which are incorporated herein.

The present invention has been appropriately and sufficiently described through the embodiments with reference to specific examples and the like in the foregoing to express the present invention, but it should be recognized that a person skilled in the art can easily change and/or improve the above-described embodiments. Therefore, unless a change or improvement made by a person skilled in the art is at a level departing from the scope of rights of the claims described in Claims, the change or improvement is interpreted to be included in the scope of rights of the claims.

INDUSTRIAL APPLICABILITY

The present invention has wide industrial applicability in the technical field related to a zinc-plated steel sheet for hot stamping, a hot stamped part obtained by using the zinc-plated steel sheet, a method for producing the same, and the like.

The invention claimed is:

1. A zinc-plated steel sheet, comprising:

a base steel sheet comprising, in % by mass:

C: 0.005 to 0.09%,

Si: 1.0 to 1.7%,

Mn: 2.1 to 3.0%,

Ti: 0.010 to 0.100%,

B: 0.0010 to 0.0100%,

Al: 0.01 to 0.10%,

P: greater than 0% to 0.10%,

S: greater than 0% to 0.010%,

N: greater than 0% to 0.010%, and iron, wherein the relationship [Ti]≥(47.8/14)[N] is satisfied when [N] and [Ti] are the % by mass of N and Ti respectively, an amount of solid-soluted B is 10 ppm or more, the base steel sheet has a hot-dip galvannealed layer or a hot dip galvanized layer on at least one face thereof, and the zinc-plated steel sheet has a maximum tensile strength of 800 MPa or more and 1300 MPa or less after hot pressed at a temperature equal to or more than an $Ac_3$ transformation point of the base steel sheet, and the $Ac_3$ transformation point of the base steel sheet is 907° C. or less, wherein the $Ac_3$ transformation point is calculated based on the following formula (1):

$$Ac_3 \text{ transformation point}(^\circ\text{ C.}) = 910 - 203\times[C]^{1/2} + 44.7\times[Si] - 30\times[Mn] + 700\times[P] + 400\times[Al] + 400\times[Ti] \quad (1)$$

wherein [C], [Si], [Mn], [P], [Al], and [Ti] are values representing the contents of C, Si, Mn, P, Al, and Ti in % by mass.

2. The zinc-plated steel sheet according to claim 1, wherein the base steel sheet further comprises one or more selected from the group consisting of Cr greater than 0% to 0.5% and Mo greater than 0% to 0.5%.

3. A method for producing a tailored blank part, the method comprising:

heat treating the zinc-plated steel sheet according to claim 1 to produce a heat treated zinc-plated steel sheet; and press forming the heat treated zinc-plated steel sheet to produce a tailored blank part, wherein the heat treated zinc-plated steel sheet has a tensile strength of 1000 MPa or more.

4. A method for producing a hot stamped part, the method comprising:

heating the zinc-plated steel sheet according to claim 1 to a temperature equal to or more than an $Ac_3$ transformation point of the base steel sheet; and hot pressing the zinc-plated steel sheet.

5. A hot stamped part comprising the zinc-plated steel sheet according to claim 1.

6. The zinc-plated steel sheet according to claim 1, wherein the base steel sheet comprises, in % by mass:

Mn: 2.2 to 3.0%.

7. The zinc-plated steel sheet according to claim 1, wherein the base steel sheet comprises, in % by mass:

Mn: 2.3 to 3.0%.

* * * * *